US008364338B2

(12) United States Patent
Peltonen et al.

(10) Patent No.: US 8,364,338 B2
(45) Date of Patent: Jan. 29, 2013

(54) METHOD, SYSTEM, AND COMPUTER SOFTWARE CODE FOR WIRELESS REMOTE FAULT HANDLING ON A REMOTE DISTRIBUTED POWER POWERED SYSTEM

(75) Inventors: Glen Paul Peltonen, Palm Bay, FL (US); Gary Mason, Melbourne, FL (US); Joseph Mario Nazareth, Rockledge, FL (US)

(73) Assignee: General Electric Company, Schenectady, NY (US)

( * ) Notice: Subject to any disclaimer, the term of this patent is extended or adjusted under 35 U.S.C. 154(b) by 459 days.

(21) Appl. No.: 12/403,557

(22) Filed: Mar. 13, 2009

(65) Prior Publication Data

US 2010/0235017 A1 Sep. 16, 2010

(51) Int. Cl.

| | |
|---|---|
| ***G06F 11/07*** | (2006.01) |
| ***G06F 11/30*** | (2006.01) |
| ***G01M 17/08*** | (2006.01) |

(52) U.S. Cl. ..... 701/29.2; 701/2; 701/19; 701/29.1

(58) Field of Classification Search ..... 105/26.05; 180/14.1; 340/500, 511; 701/2, 19, 23, 24, 701/29, 31, 33–35, 39, 29.1–29.3, 31.4–31.7, 701/32.7; 702/58, 182, 183, 185, 188; 700/3, 700/9, 11, 12, 21, 26, 27, 78–81

See application file for complete search history.

(56) References Cited

U.S. PATENT DOCUMENTS

| | | | | |
|---|---|---|---|---|
| 4,041,470 | A * | 8/1977 | Slane et al. | 701/35 |
| 4,774,669 | A | 9/1988 | Schmitz et al. | |
| 5,890,080 | A * | 3/1999 | Coverdill et al. | 701/29 |
| 6,095,618 | A * | 8/2000 | Heneka et al. | 303/3 |
| 6,128,555 | A * | 10/2000 | Hanson et al. | 701/13 |
| 6,135,396 | A * | 10/2000 | Whitfield et al. | 246/182 R |
| 6,542,076 | B1 * | 4/2003 | Joao | 340/539.14 |
| 6,876,907 | B2 * | 4/2005 | Kanner et al. | 701/19 |
| 6,886,472 | B2 * | 5/2005 | Jammu et al. | 105/26.05 |
| 2002/0059075 | A1 | 5/2002 | Schick et al. | |
| 2003/0055666 | A1 | 3/2003 | Roddy et al. | |
| 2006/0025903 | A1 | 2/2006 | Kumar | |
| 2008/0027591 | A1 * | 1/2008 | Lenser et al. | 701/2 |

OTHER PUBLICATIONS

International Search Report issued in connection with corresponding PCT Application No. PCT/US2010/023999 on Jun. 7, 2010.

Written Opinion issued in connection with corresponding PCT Application No. PCT/ US2010/023999 on Jun. 7, 2010.

* cited by examiner

*Primary Examiner* — Joseph Rocca
*Assistant Examiner* — Laura Freedman
(74) *Attorney, Agent, or Firm* — GE Global Patent Operation; John A. Kramer

(57) ABSTRACT

A method for remotely administering a fault detected on an unmanned powered system that is controlled through a lead powered system, the method including detecting an operational fault on an unmanned powered system, communicating information about the fault to the lead powered system, through a wireless communication protocol operable with a wireless communication system, and communicating a reset message to the unmanned powered system to reset the fault detected. A system and computer software code, stored on a computer readable media and executable with a processor, are also disclosed for remotely handling a fault detected on an unmanned powered system that is controlled through a lead powered system.

5 Claims, 3 Drawing Sheets

METHOD, SYSTEM, AND COMPUTER SOFTWARE CODE FOR WIRELESS REMOTE FAULT HANDLING ON A REMOTE DISTRIBUTED POWER POWERED SYSTEM

BACKGROUND OF THE INVENTION

This invention relates generally to communication systems and, more particularly, to detecting and resetting a remote fault with a wireless communication protocol.

Powered systems such as, but not limited to, an off-highway vehicle, marine powered propulsion plant or marine vessel, rail vehicle systems or trains, stationary power plants, agricultural vehicles, and transport vehicles, usually are powered by a power unit, such as but not limited to a engine, such as but not limited to a diesel engine. With respect to rail vehicle systems, the powered system is a locomotive, which may be part of a train that further includes a plurality of rail cars, such as freight cars. Usually more than one locomotive is provided as part of the train, where a grouping of locomotives is referred to as a locomotive "consist." Locomotives are complex systems with numerous subsystems, with each subsystem being interdependent on other subsystems.

With respect to a train, under operator control, a railroad locomotive supplies motive power (traction) to move the locomotive and a load (e.g., non-powered railcars and their contents), and applies brakes on the locomotive and/or on the non-powered railcars to slow or stop the train. With respect to the locomotive, the motive power is supplied by electric traction motors responsive to an AC or DC power signal generated by the locomotive engine.

A railroad train has three separate brake systems. An air brake system includes a fluid-carrying (typically the fluid includes air) brake pipe that extends a length of the train and a railcar brake system. Wheel brakes are applied or released at each locomotive and at each railcar in response to a fluid pressure in the brake pipe. An operator-controlled brake handle controls the brake pipe pressure, venting the brake pipe to reduce the pressure to signal the locomotives and railcars to apply the brakes, or charging the brake pipe to increase the pressure to signal the locomotive and railcars to release the brakes. For safe train operation, when pressure in the brake pipe falls below a threshold value the brakes default to an applied condition.

Each locomotive also has an independent pneumatic brake system controlled by the operator to apply or release the locomotive brakes. The independent pneumatic brake system, which is coupled to the air brake system, applies the locomotive brakes by increasing the pressure in the locomotive brake cylinders and releasing the locomotive brakes responsive to a decrease in the cylinder air pressure.

Finally, each locomotive is equipped with a dynamic brake system. Activation of the dynamic brakes reconfigures the locomotive's traction motors to operate as generators, with the inertia of the locomotive wheels supplying rotational energy to turn the generator rotor winding. Magnetic forces, developed by generator action, resist wheel rotation and thus create wheel-braking forces. The energy produced by the generator is dissipated as heat in a resistor grid in the locomotive and removed by one or more cooling blowers. Use of the dynamic brakes is indicated to slow the train when application of the locomotive independent brakes and/or the railcar air brakes may cause the locomotive or railcar wheels to overheat or when prolonged use may cause excessive wheel wear. For example, the dynamic brakes may be applied when the train is traversing a prolonged downgrade.

A train configured for distributed power (DP) operation has a lead locomotive at a head-end of the train, and one or more remote locomotives between the head-end and an end of the train. A DP train may also include one or more locomotives at the end of the train. The DP system further includes a distributed power train control and communications system with a communications channel (e.g., a radio frequency (RF) or a wire-based communications channel) linking the lead and remote locomotives. Though DP operation is disclosed specific to trains, similar systems are also applicable for other powered systems disclosed herein.

The DP system generates traction and brake commands responsive to operator-initiated (e.g., the operator in the lead locomotive) control of a lead locomotive traction controller (or throttle handle) or a lead locomotive brake controller (responsive to operation of an air brake handle, a dynamic brake handle or an independent brake handle). These traction or brake commands are transmitted to the remote locomotives over the DP communications channel. The receiving remote locomotives respond to the traction or brake (apply and release) commands to apply tractive effort or to apply/release the brakes and further advise the lead locomotive that the command was received and executed. For example, when the lead locomotive operator operates the lead-locomotive throttle controller to apply tractive effort at the lead locomotive, according to a selected throttle notch number, the DP system issues commands to each remote locomotive to apply the same tractive effort (e.g., the same notch number). Each remote locomotive replies to acknowledge execution of the command.

An example of a DP train control and communications systems is the LOCOTROL® distributed power communications system available from the General Electric Company of Fairfield, Conn. The LOCOTROL® distributed power system includes a radio frequency link (channel) and receiving and transmitting devices at the lead and the remote locomotives.

FIG. 1 schematically illustrates an exemplary distributed power train 10, traveling in a direction indicated by an arrowhead 11. A remote locomotive 12A (also referred to as a remote unit) is controlled by messages transmitted from either a lead locomotive 14 (also referred to as a lead locomotive) or from a control tower 16. Control tower commands are issued by a dispatcher either directly to the remote locomotive 12A or to the remote locomotive 12A via the lead locomotive 14.

A trailing locomotive 15 coupled to the lead locomotive 14, forming a consist, is controlled by the lead locomotive 14 via control signals carried on an MU (multiple locomotive) line 17 connecting the two units. Also, a trailing remote locomotive 12B coupled to the remote locomotive 12A, forming another consist, is controlled by the remote locomotive 12A via control signals carried on the MU line 17.

Each of the locomotives 14 and 12A and the control tower 16 includes a DP transceiver 28L, 28R, 28T (also referred to as a DP radio) and a DP antenna 29 for receiving and transmitting the DP communication messages. The DP transceivers are referred to by suffixed reference numerals 28L, 28R and 28T indicating location in the lead locomotive, remote locomotive, and the control tower, respectively.

The DP commands are typically generated in a lead station 30L in the lead unit 14 responsive to operator control of the motive power and braking controls in the lead locomotive 14, as described above. The remote locomotive 12A also includes a remote station 32R for processing messages from the lead locomotive 14 and for issuing reply messages and commands.

The distributed power train 10 further comprises a plurality of railcars 20 interposed between the locomotives illustrated in FIG. 1 and connected to a brake pipe 22. The railcars 20 are provided with an air brake system (certain components of which are not shown in FIG. 1) that applies the railcar air brakes in response to a pressure drop in the brake pipe 22 and releases the air brakes in response to a pressure increase in the brake pipe 22. The brake pipe 22 runs the length of the train for conveying the air pressure changes specified by air brake controllers 24 in the locomotives 14 and 12A.

To further improve system reliability, one embodiment of a distributed power train communications system has an off-board repeater 26 for receiving messages sent from the lead locomotive 14 and repeating (retransmitting) the message for receiving by the remote locomotive 12A. This embodiment may be practiced along a length of track that passes through a tunnel, for example. In such an embodiment the off-board repeater 26 has an antenna 35 (e.g., a leaky coaxial cable mounted along the tunnel length) and a remote station 37 for receiving and retransmitting lead messages.

The lead locomotive also issues status request messages and the remote locomotives respond with operational data. The lead and remote locomotives can also issue alarm or fault messages. However, currently, when alarm or fault messages are issued, the operator must stop the train and then go to the remote locomotive reporting the fault to address the fault. Stopping the mission results in the mission costing more (in terms of time and/or fuel) since the mission will take longer. Additionally, if a mission plan is being followed, stopping and starting the train to address fault messages will greatly prohibit completion of the mission plan within the parameters of the mission plan. Similar situations may also arise with other powered systems that operate together to complete a mission. Towards this end, owners and operators of powered systems would realize financial benefits in having a way to reduce stopping time of powered systems due to operational faults realized when the multiple powered systems are operating together for a common mission.

BRIEF DESCRIPTION OF THE INVENTION

Embodiments of the present invention relate to a method, system, and computer software code for remotely handling, or administering, an operational fault detected on an unmanned powered system that is operating in conjunction with at least a lead powered system where an operator is located. The method includes detecting an operational fault on an unmanned powered system. Information about the fault is communicated to the lead powered system through a wireless communication system. A reset message is communicated through the wireless communication system to the unmanned powered system, to reset the detected operational fault.

In another embodiment, the system includes a first processor that is part of a lead powered system and that is configured to detect an operational fault of the lead powered system and/or develop a fault reset message. A second processor is part of a remote powered system and is configured to detect an operational fault of the remote powered system, develop a fault message, and reset the operational fault upon receipt of the fault reset message. A wireless communication system is provided to communicate (specifically, transmit and/or receive) the fault message and the fault reset message between the first processor and the second processor.

In yet another embodiment, the computer software code is stored on a computer readable media and executable with a processor. The computer software code includes a computer software module for detecting an operational fault on an unmanned powered system, when executed with the processor. A computer software module is also included for initiating communication of information about the detected operational fault to the lead powered system through a wireless communication system, when executed with the processor. The computer software code also includes a computer software module for initiating communication of a reset message to the unmanned powered system, through the wireless communication system, to reset the detected operational fault, when executed with the processor.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the embodiments of the invention will be described and explained with additional specificity and detail through the use of the accompanying drawings in which.

DETAILED DESCRIPTION OF THE INVENTION

Figure 1:
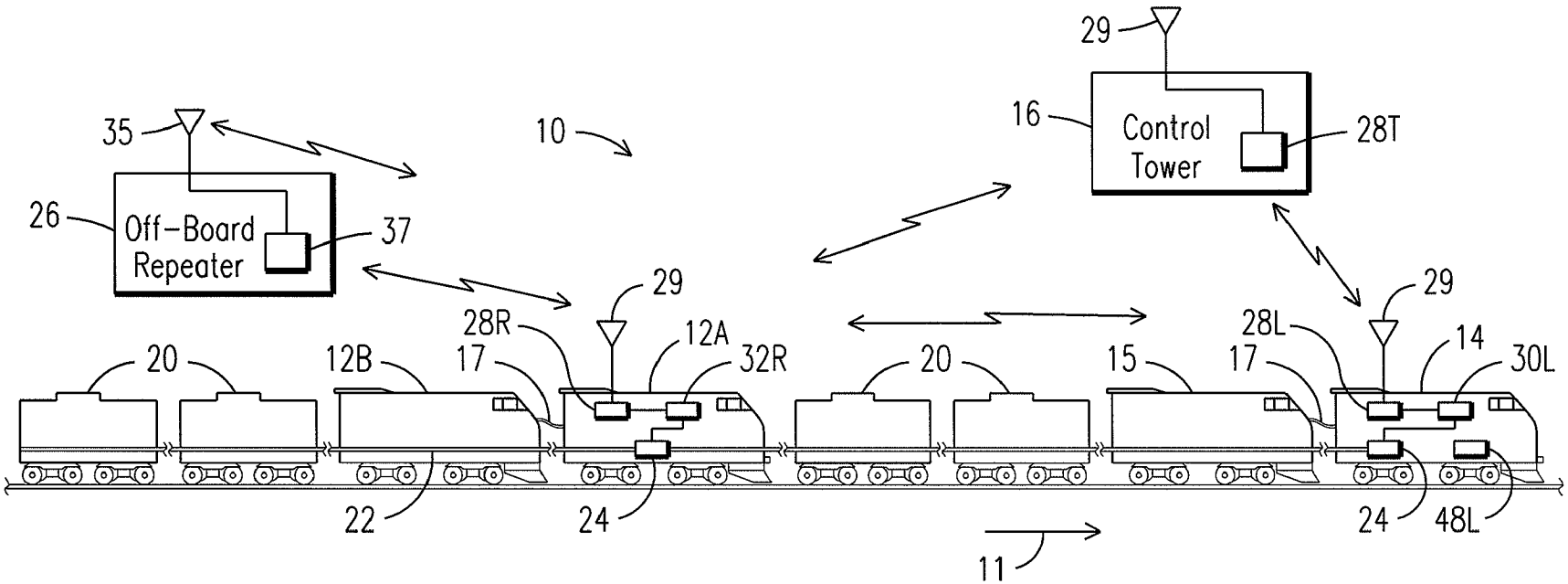
FIG. 1 PRIOR ART
FIG. 1 illustrates a prior art representation of distributed power train to which the teachings of the present invention can be applied.

Reference will be made below in detail to exemplary embodiments of the invention, examples of which are illustrated in the accompanying drawings. Wherever possible, the same reference numerals used throughout the drawings refer to the same or like parts. As disclosed below, multiple versions of a same element may be disclosed. Likewise, with respect to other elements, a singular version is disclosed. Neither multiple versions disclosed nor a singular version disclosed shall be considered limiting. Specifically, although multiple versions are disclosed, a singular version may be utilized. Likewise, where a singular version is disclosed, multiple versions may be utilized.

Though exemplary embodiments of the present invention are described with respect to rail vehicles, or railway transportation systems, specifically trains and locomotives, exemplary embodiments of the invention are also applicable for use with other powered systems, such as but not limited to marine vessels, stationary units such as power plants, off-highway vehicles, agricultural vehicles, and/or transportation vehicles, each which may use at least one engine. Towards this end, when discussing a specified mission, this includes a task or requirement to be performed by the powered system. Therefore, with respect to a railway vehicle, marine vessel, agricultural vehicle, transportation vehicle, or off-highway vehicle applications, this may refer to the movement of a collective powered system (where more than one individual powered system is provided) from a present location to a destination. In the case of stationary applications, such as but not limited to a stationary power generating station or network of power generating stations, a specified mission may refer to an amount of wattage (e.g., MW/hr) or other parameter or requirement to be satisfied by the powered system.

Though diesel powered systems are readily recognized when discussing trains or locomotives, those skilled in the art will readily recognize that embodiments of the invention may also be utilized with non-diesel powered systems, such as but not limited to natural gas powered systems, bio-diesel powered systems, etc. Furthermore, the individual powered system may include multiple engines, other power sources, and/or additional power sources, such as, but not limited to, battery sources, voltage sources (such as but not limited to capacitors), chemical sources, pressure based sources (such as but not limited to spring and/or hydraulic expansion), electrical current sources (such as but not limited to inductors), inertial sources (such as but not limited to flywheel devices), gravitational-based power sources, and/or thermal-based power sources. Additionally, the power source may be external, such as, but not limited to, an electrically powered system, such as a locomotive or train, where power is sourced externally from overhead catenary wire, a third rail, and/or magnetic levitation coils.

Exemplary embodiments of the invention solve problems in the art by providing a method, system, and computer implemented method, such as a computer software code or computer readable media, for remotely handling, or administering, a fault detected on an unmanned powered system that is operating in conjunction with at least a lead powered system where an operator is located. With respect to locomotives, exemplary embodiments of the present invention are also operable when the locomotive consist is in distributed power operations. Distributed power operations, however, are not only applicable to locomotives or trains. The other powered systems disclosed herein may also operate in a distributed power configuration.

In this document the term "locomotive consist" is used. As used herein, a locomotive consist may be described as having one or more locomotives in succession, connected together so as to provide motoring and/or braking capability. The locomotives are connected together where no train cars are in between the locomotives. The train can have more than one locomotive consists in its composition. Specifically, there can be a lead consist and one or more remote consists, such as midway in the line of cars and another remote consist at the end of the train. Each locomotive consist may have a first locomotive and trail locomotive(s). Though a first locomotive is usually viewed as the lead locomotive, those skilled in the art will readily recognize that the first locomotive in a multi locomotive consist may be physically located in a physically trailing position.

Though a locomotive consist is usually viewed as involving successive locomotives, those skilled in the art will readily recognize that a consist group of locomotives may also be recognized as a consist even when one or more rail cars separate the locomotives, such as when the locomotive consist is configured for distributed power operation, wherein throttle and braking commands are relayed from the lead locomotive to the remote trains by a radio link or physical cable. Towards this end, the term locomotive consist should not be considered a limiting factor when discussing multiple locomotives within the same train.

As disclosed herein, the idea of a consist may also be applicable when referring to other types of powered systems including, but not limited to, marine vessels, off-highway vehicles, agricultural vehicles, and/or stationary power plants, that operate together so as to provide motoring, power generation, and/or braking capability. Therefore, even though the term locomotive consist is used herein in regards to certain illustrative embodiments, this term may also apply to other powered systems. Similarly, sub-consists may exist. For example, the powered system may have more than one power generating unit. For example, a power plant may have more than one diesel electric power unit where optimization may be at the sub-consist level. Likewise, a locomotive may have more than one diesel power unit. Furthermore though the exemplary examples are disclosed with respect to a rail vehicle, such disclosures are not to be considered limiting. The exemplary embodiments are also applicable to the other powered systems disclosed herein.

Persons skilled in the art will recognize that an apparatus, such as a data processing system, including a CPU, memory, I/O, program storage, a connecting bus, and other appropriate components, could be programmed or otherwise designed to facilitate the practice of the method of the invention. Such a system would include appropriate program means for executing the method of the invention.

Also, an article of manufacture, such as a pre-recorded disk, computer readable media, or other similar computer program product, for use with a data processing system, could include a storage medium and program means recorded thereon for directing the data processing system to facilitate the practice of the method of the invention. Such apparatus and articles of manufacture also fall within the spirit and scope of the invention.

Broadly speaking, a technical effect is to remotely resolve a fault detected on an unmanned powered system that is operating in conjunction with at least a lead powered system. To facilitate an understanding of the exemplary embodiments of the invention, it is described hereinafter with reference to specific implementations thereof. Exemplary embodiments of the invention may be described in the general context of computer-executable instructions, such as program modules, being executed by any device, such as but not limited to a computer, designed to accept data, perform prescribed mathematical and/or logical operations usually at high speed, where results of such operations may or may not be displayed. Generally, program modules include routines, programs, objects, components, data structures, etc. that perform particular tasks or implement particular abstract data types. For example, the software programs that underlie exemplary embodiments of the invention can be coded in different programming languages, for use with different devices, or platforms. In the description that follows, examples of the invention may be described in the context of a web portal that employs a web browser. It will be appreciated, however, that the principles that underlie exemplary embodiments of the invention can be implemented with other types of computer software technologies as well.

Moreover, those skilled in the art will appreciate that exemplary embodiments of the invention may be practiced with other computer system configurations, including hand-held devices, multiprocessor systems, microprocessor-based or programmable consumer electronics, minicomputers, mainframe computers, and the like. Exemplary embodiments of the invention may also be practiced in distributed computing environments where tasks are performed by remote processing devices that are linked through at least one communications network. In a distributed computing environment, program modules may be located in both local and remote computer storage media including memory storage devices.

Referring now to the drawings, embodiments of the present invention will be described. Exemplary embodiments of the invention can be implemented in numerous ways, including as a system (including a computer processing system), a method (including a computerized method), an apparatus, a computer readable medium, a computer program product, a graphical user interface, including a web portal, or a data structure tangibly fixed in a computer readable memory. Several embodiments of the invention are discussed below.

Figure 2:
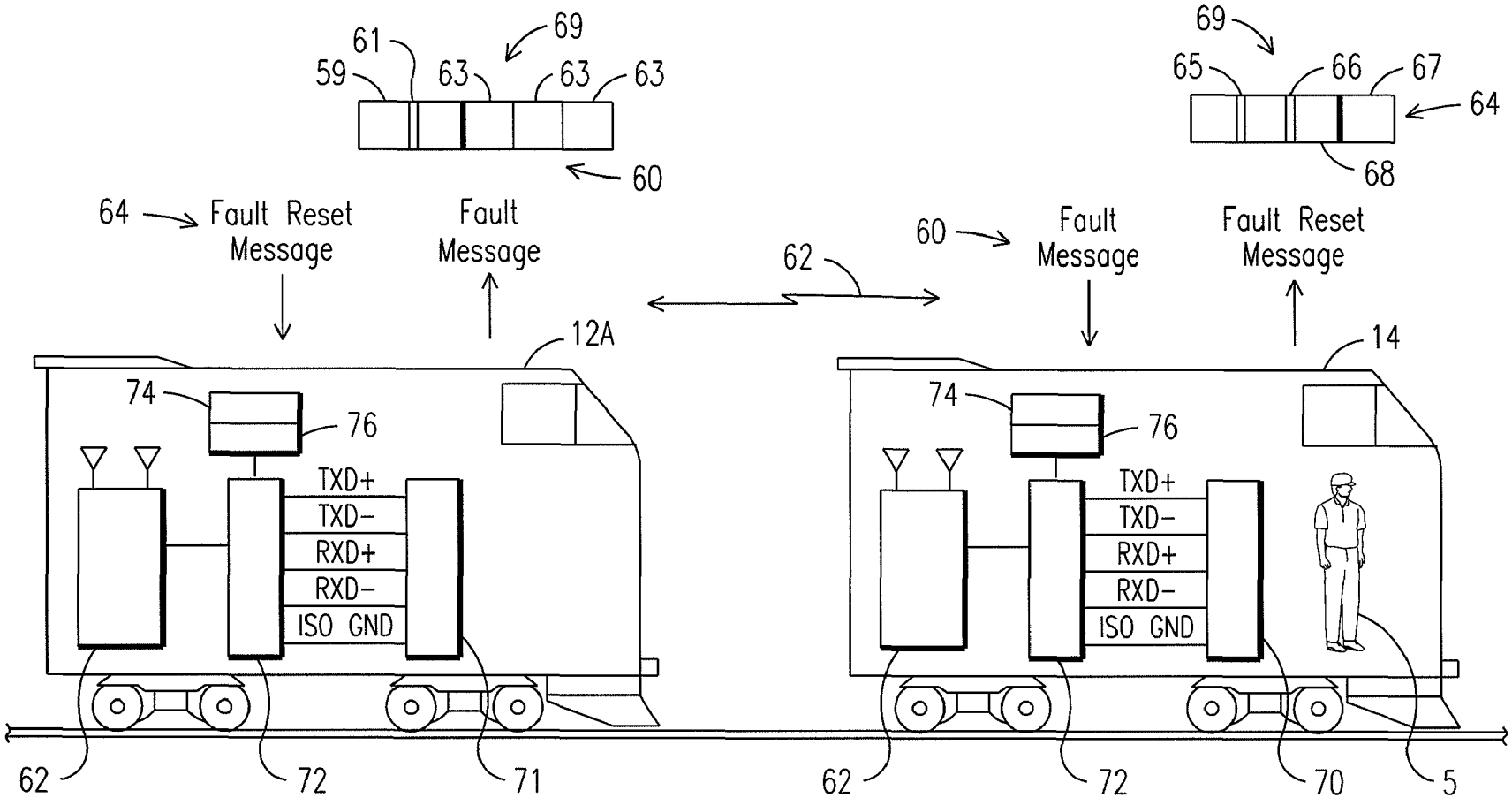
FIG. 2 illustrates, in block diagram form, elements for reporting and acting on a fault message.

FIG. 2 illustrates a representation of a wireless communication system operable with a wireless communication protocol for communication of a fault message and a fault reset message between a lead locomotive and a remote locomotive. (The lead and remote locomotives are not shown as connected in FIG. 2, but typically would be directly or indirectly coupled together as part of a train 10.) When a fault is detected at the remote locomotive 12A, a wireless fault message 60 is created at the remote locomotive 12A and is communicated (specifically, transmitted and received) from the remote locomotive 12A, using a wireless communication system 62, to the lead locomotive 14, typically where an operator 5 is located. The fault message 60 is specific for a wireless communication protocol 69 that is operable with the wireless communication system 62. The wireless communication protocol 69 provides a remote status message 59, a fault present flag 61, and a fault code byte 63. Hence, the fault message 60 may include a remote status message 59, and a fault present flag 61. Depending on the type of fault, the fault message 60 may further include a fault code byte 63 (that is, the fault code reflects the type of fault and/or location of fault in question).

In operation, when no fault is detected, a remote status message 59 is sent without a fault present flag and/or the fault code byte. When a fault is detected, the fault present flag 61 is included as part of the remote status message. The fault present flag 61 notifies the lead locomotive that a fault has been detected and to look for the fault code byte 63, which should be added to the remote status message 59. Adding only the fault code byte 63 when a fault is detected minimizes the bandwidth of the remote status message 59 when a fault is not detected. Therefore, though three fault code bytes 63 are illustrated, each byte 63 is only added when a different fault is detected. The fault code byte may be divided where a first part of the byte identifies the fault and a second part of the byte identifies which remote locomotive is experiencing the fault.

A wireless fault reset message 64 is provided to reset the fault detected. The fault reset message 64 is communicated using the wireless communication protocol 69 over the wireless communication system 62, from the lead locomotive 14 to the remote locomotive 12A. The wireless communication protocol 69 provides for a command message 68, a fault reset flag 65, an acknowledge byte present flag 66, and a fault acknowledge byte 67. The command message 68 is the message that is typically relayed to a remote locomotive 12A during operation of the train. Thus, the fault reset message 64 may have a command message 68, which is generated at the lead locomotive 14 and is communicated, using the wireless communication system 62, to the remote locomotive 12A experiencing the fault. In another example, the fault reset message 64 is wirelessly communicated to all locomotives in the train. The fault reset message 64 includes a train wide fault reset flag 65 and an acknowledge byte present flag 66 within the command message 68. Depending on the fault, a fault acknowledge byte 67 may be added to the command message 68, where the fault acknowledge byte 67 may be specific to a certain remote locomotive 12A.

In operation, if there is not a need to send the fault acknowledge byte 67, the length of the command message 68 is kept to a minimum length since the fault acknowledge byte, train wide fault reset flag 65, and acknowledge byte present flag 66 are not included. If a fault is received from a specific remote locomotive 12A, the command message 68 includes the acknowledge byte present flag 66 directed to that specific remote locomotive 12A and the fault acknowledge byte 67 directing the remote locomotive 12A to reset the detected fault. If all remote locomotives are experiencing a same and/or similar fault, the train wide fault reset flag 65 is included as part of the command message 68 and directs each remote locomotive 12A to reset the respective fault. After receipt of the fault reset message 64, if the remote locomotive 12A does not send the acknowledge byte present flag 66 back to the lead locomotive 14, another command message 68, including the acknowledge byte present flag 66 and fault acknowledge byte 67 are again sent from the lead locomotive motive 14 to the remote locomotive 12A.

Depending on the fault, since more than one remote locomotive 12A, 12B may be part of a train 10, a message format for the fault message 60 and the fault reset message 64 includes an identification of the specific remote locomotive. In another embodiment, because a plurality of trains may be operating in close proximity, the message format also includes an identification of the lead locomotive. Therefore, when the fault message 60 is sent, the correct lead locomotive will receive the fault message 60, and when the fault reset message 64 is sent, the correct remote locomotive will receive the fault reset message 64.

Each locomotive 12A, 14 is equipped with a wireless communication system 62 (such as but not limited to a radio module) and a locomotive computer or other first processor 70, 71 used in operation of each locomotive. (The term "processor," as used herein, refers to a controller, computer, microprocessor, or other control system for a powered system.) For clarification, though the first processors may be the same type on both the lead locomotive 14 and the remote locomotive 12A, the lead locomotive has the first processor 70 and the remote locomotive has a second processor 71. (As should be appreciated, therefore, the first processor 70 on the lead locomotive and the second processor 71 on the remote locomotive may each be configured to detect a fault condition on the respective locomotive. In this manner, for purposes of the remote fault administration system described herein, the locomotive currently being used as a lead locomotive in one train 10 may be used as a remote locomotive in a future train.) A third processor 72 is further configured to allow messages to be sent from the locomotive computer 70 through the wireless communication system 62. (As indicated in FIG. 2, each locomotive may have a third processor 72.) An example of the third processor 72 is an expanded integrated processor module ("XIPM") developed by General Electric Company. The third processor 72 includes a serial interface connection for communicating with the locomotive computer 70, 71. The software, algorithm, or computer-readable instructions executed by the processors may be based on a locomotive system integration ("LSI") standard. As further illustrated, communication lines for transmitting data, TXD (TXD+, TXD−), and communication lines for receiving data, RXD (RXD+, RXD−), are provided for communication between the third processor 72 and the locomotive computer 70, 71. A line providing a ground (ISO GND) is also provided. Though the locomotive computer 70, 71 and the third processor 72 are disclosed as being two separate processors or computers, those skilled in the art will readily recognize that a single processor (e.g., computer) may be used having the features disclosed herein.

On the lead locomotive 14, a notification device 74, such as a display, is also provided. As disclosed above, the notification device may be a visual system, audible system, and/or a system that allows for physically touching the operator. In an exemplary embodiment, since the remote locomotive may be a lead locomotive in a subsequent mission, the notification device 74 is also provided on the remote locomotive.

In one embodiment, the fault reset message 64 is initiated by the operator 5. Once the operator 5 is provided with the fault message 60, such as through the notification device 74, the operator 5 will enter information used in the fault reset message 64 that is sent to the remote locomotive. The operator 5 may enter the information using an interface device 76, e.g., control panel, associated with the notification device 74, or independent of the notification device 74. In another embodiment, the locomotive computer 70 on the lead locomotive 14 is configured to receive the fault message 60 and determines an appropriate fault reset message 64. Once the appropriate fault reset message 64 is determined, the fault reset message 64 may be provided to the operator 5, through the notification device 74, to verify before the operator 5 authorizes delivery, or in a closed-loop configuration the fault rest message 64 is automatically sent without the operator's intervention. If the operator 5 does not intervene, as in the closed-loop configuration, the operator 5 may receive notification of the fault reset message 64 after it has been sent to the remote locomotive 12A.

Figure 3:
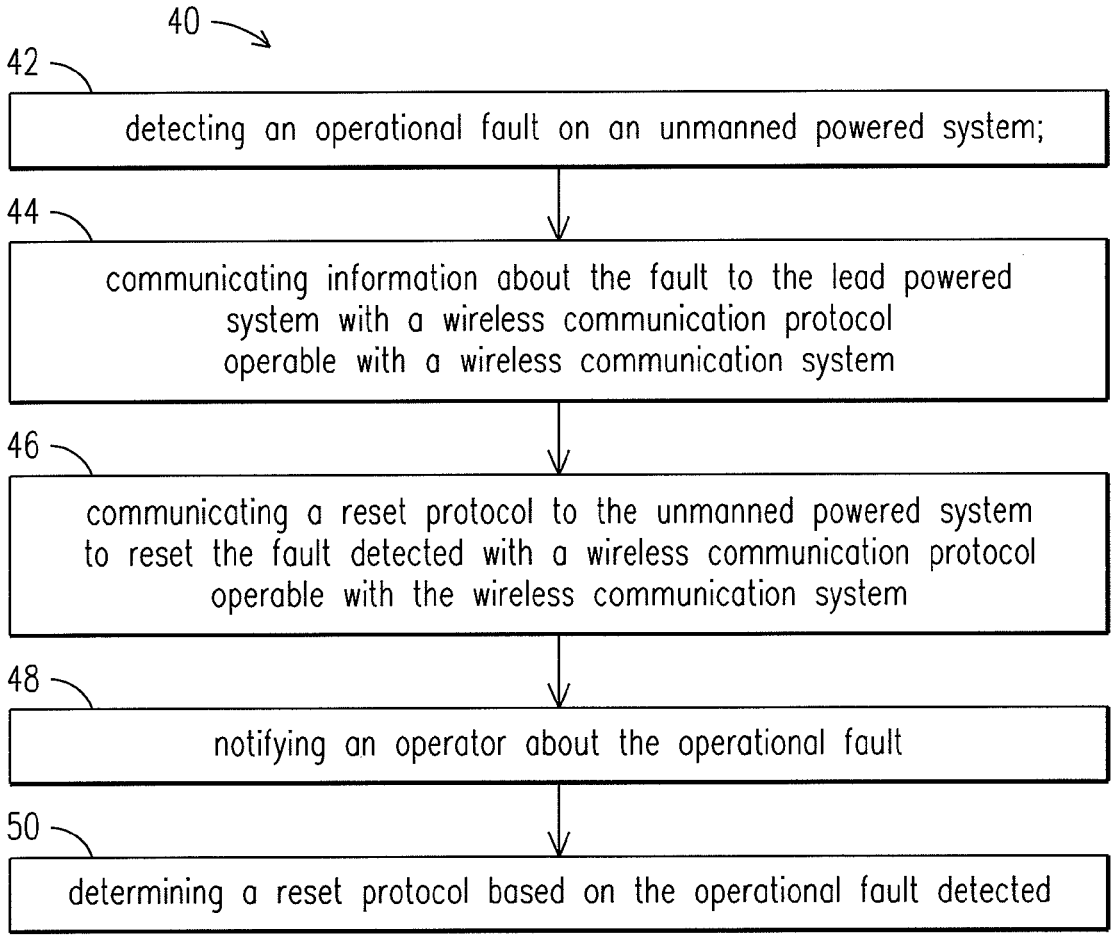
FIG. 3 depicts a flowchart illustrating an exemplary method for remotely handling a fault detected on an unmanned powered system.

FIG. 3 depicts a flowchart 40 illustrating an exemplary method for remotely handling a fault detected on an unmanned powered system. The method of flowchart 40 comprises detecting an operational fault on an unmanned powered system, at 42. The method continues at 44, with communicating information (e.g., included in the fault message) to the lead powered system through a wireless communication protocol operable with a wireless communication system. A fault reset message is communicated to the unmanned powered system to reset the detected fault, by way of the wireless communication protocol operable with a wireless communication system, at 46. The reset message is determined based on the operational fault detected, at 50. Communicating the reset message may be initiated or performed by the operator and/or by a fault control device, such as but not limited to the lead locomotive computer as disclosed in more detail with respect to FIG. 2.

The operator is notified about the operational fault, at 48. Notifying the operator 5 may be accomplished by visually notifying the operator, audibly notifying the operator, and/or notifying the operator through physical contact. Visually notifying the operator may involve a use of a display which the operator may view. Audibly notifying the operator may involve a sound emitting device which may emit a sound specific to the fault. Physical contact notifying the operator may involve a device connected to the operator where an electronic pulse is provided when the fault message is received. Each of the notification techniques may be used individually or in any combination of two or more. For example, an audible notification may occur which directs the operator to view a visual display.

Those skilled in the art will readily recognize that the method disclosed in the flowchart 40 transforms information about an operational fault from a data stream to a means for notifying the operator, which as disclosed above is no longer a data stream. (That is, fault data is transformed into a format suitable for communication to a human operator.) Furthermore, those skilled in the art will also readily recognize that a wireless communication system which operates using the wireless communication protocol disclosed herein is a particular machine, and hence is not a general purpose computer or machine.

Those skilled in the art will readily recognize that the method shown in flowchart 40 may be implemented with a computer software code that is storable on computer media and is operatable with a processor. With respect to the method shown in flowchart 40, a computer software module is provided for detecting an operational fault on an unmanned powered system, when executed with the processor. A computer software module is further provided for initiating communicating information about the fault to the lead powered system, through a wireless communication protocol operable with a wireless communication system, when executed with the processor. A computer software module initiates communication a reset message to the unmanned powered system to reset the fault detected, through a wireless communication protocol operable with the wireless communication system, when executed with the processor.

In operation, when a fault is detected and reported to the operator 5 and/or the locomotive computer 70 on the lead locomotive 14, instead of stopping the train so that the operator 5 may walk back to the remote locomotive 12A that reported the fault, the operator 5 and/or the locomotive computer 70 on the lead locomotive 14 is able to communicate the fault reset message 64 to the remote locomotive 12A to correct the fault. This communication is accomplished with the wireless communication protocol 69 that is operable with the wireless communication system 62. By doing so, any mission objectives that are trying to be met, such as but not limited to trip time, will not be affected by having to stop and then start the mission so that the operator 5 can move to the remote locomotive 12A to address the reason for the fault message 60.

An example of a type of fault is a traction motor overcurrent fault, specifically where too much current is detected at a traction motor. A fault is declared and the traction motor is powered down. The reset message would allow for this fault to be reset and hence the traction motor to operate again. Therefore if the fault is an anomaly, the mission benefits from the traction motor operating are not lost during the rest of the mission.

The remote fault administration system (FIGS. 2 and 3) may be configured to differentiate between different types of faults, wherein fault reset messages 64 are communicated only if it is possible to remotely correct the fault in question. In particular, certain faults may be of the type that require the train to be stopped no matter what, in which case the system does not transmit a fault reset message. As should be appreciated, even if certain faults require the train to be stopped, slowed, etc., the system can still use the remote fault administration protocol 69 to communicate information about the fault to the lead locomotive 14. In such a case, if a fault is detected, a fault message 60 is generated and transmitted from the remote locomotive to the lead locomotive. The lead locomotive determines the type of fault from the fault message 60, and if the fault is of a type that cannot be remotely corrected, the lead locomotive processes the fault "as normal" (that is, in a manner as if the remote fault administration system was not present on the train), instead of transmitting a fault reset message.

As should be appreciated, the term "wireless communication system" refers to a medium for communicating wirelessly (e.g., a radio frequency bandwidth) and equipment for transmitting and receiving data over the medium. "Wireless communication protocol" refers to a particular format for communicating over the wireless communication system, in this case, a message format for messages 60, 64 communicated between lead locomotives and remote locomotives (for purposes of communicating and resetting faults), wherein the message format is configured so that the messages are dissimilar from other wireless messages used in the train (e.g., wireless DP commands).

In one embodiment, the wireless communication system 62 is a dedicated communication system for the remote fault administration system. That is, the communication system 62 is only used for communicating fault messages, fault reset messages, and related communications. In another embodiment, the wireless communication system 62 is used for other purposes in the train. For example, in one embodiment the wireless communication system 62 is a train's existing DP communication system, as described above in regards to FIG. 1. In such a case, as discussed, the wireless communication protocol 69 is configured so that messages 60, 64 generated by the fault administration system are not confused with DP messages or other communications in the train unrelated to remote fault administration.

Another embodiment of the present invention relates to a fault administration system for powered systems 14, 12A. The system comprises a wireless communication system 62 linking a first powered system 14 and an unmanned, second powered system 12A. The second powered system 12A is controlled through the first powered system 14. The system further comprises a fault processor (71 and/or 72) on the second powered system 12A. The fault processor is configured to communicate a fault message 60 to the first powered system 14. The fault message 60 relates to a detected operational fault of the second powered system 12A. The fault processor is further configured to initiate corrective action regarding the detected operational fault subsequent to receiving a fault reset message 64 from the first powered system 14.

Another embodiment relates to a fault administration system for a train. The system comprises a distributed power communication system 62 that wirelessly links a first locomotive 14 in the train 10 with a second locomotive 12A in the train 10. The second locomotive 12A is unmanned. The system further comprises a fault processor (71 and/or 72) on the second locomotive 12A. The fault processor is configured to communicate a fault message 60 to the first locomotive 14. The fault message 60 relates to a detected operational fault of the second locomotive 12A. The fault processor is further configured to initiate corrective action regarding the detected operational fault subsequent to receiving a fault reset message 64 from the first locomotive. The fault message 60 and the fault reset message 64 are configured according to a communication protocol 69 for wireless transmission over the distributed power communication system 62 in a message format different than a format of distributed power messages transmitted over the communication system 62 for distributed power control of the first and/or second locomotives. The fault reset message 64 may be generated by the first locomotive 14 based on the contents of the fault message 60 it receives from the second locomotive.

Another embodiment relates to a fault administration system for powered systems. The fault administration system comprises a wireless communication system 62 linking a first powered system 14 with an unmanned, second powered system 12A. The second powered system is controlled through the first powered system. The first and second powered systems are configured to exchange fault administration messages 60, 64. The messages 60, 64 are configured according to a wireless protocol 69 for transmission over the wireless communication system.

The term "unmanned" refers to a powered system wherein a human operator is not currently on board the powered system for operating the powered system. This does not preclude powered systems that include operator interface equipment for operator control at another time, or humans on board a powered system for purposes unrelated to controlling the powered system, e.g., passengers.

While the invention has been described with reference to various exemplary embodiments, it will be understood by those skilled in the art that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. A method comprising:

detecting an operational fault on an unmanned locomotive of a train in a distributed power (DP) configuration having the unmanned locomotive and a lead locomotive coupled with each other by one or more railcars disposed between the lead locomotive and the unmanned locomotive;

communicating information about the operational fault to the lead locomotive through a wireless communication system between the lead locomotive and the unmanned locomotive;

determining if the operational fault is of a type that requires the train to be stopped or if the operational fault is of a type that may be corrected remotely; and autonomously communicating a reset message to the unmanned locomotive to reset one or more components of the unmanned locomotive that are associated with the operational fault that is detected through the wireless communication system between the lead locomotive and the unmanned locomotive, wherein the reset message is communicated to the unmanned locomotive without operator intervention after the lead locomotive receives the information about the operational fault, wherein the reset message is communicated only if the operational fault is of the type that may be corrected remotely.

2. A system comprising:

a first processor configured to be disposed on a lead locomotive of a train in a distributed power (DP) configuration having the lead locomotive and a remote locomotive coupled together and separated from each other by at least one railcar of the train; and a second processor configured to be disposed on the remote locomotive and configured to detect an operational fault of one or more components of the remote locomotive, the second processor also configured to wirelessly communicate a fault message representative of the operational fault that is detected to the lead locomotive; wherein the first processor is configured to determine if the operational fault is of a type that requires the train to be stopped or if the operational fault is of a type that may be corrected remotely, wherein the first processor on the lead locomotive is configured to wirelessly communicate a fault reset message upon receipt of the fault message that is wirelessly received from the second processor, the fault reset message directing the one or more components of the remote locomotive that are associated with the operational fault to reset in response to the operational fault, wherein, when the fault message is wirelessly received from the remote locomotive, the first processor is configured to autonomously develop the fault reset message without operator intervention, and wherein the fault reset message is communicated, without operator intervention, only if the operational fault is of the type that may be corrected remotely.

3. A computer software code stored on a computer readable media and executable with a processor, the computer software code comprising one or more software modules configured to direct the processor to:

determine detection of an operational fault of one or more components on an unmanned locomotive in a train in a distributed power (DP) configuration, the DP configuration of the train including the unmanned locomotive coupled with a lead locomotive by one or more railcars disposed between the lead locomotive and the unmanned locomotive;

determine if the operational fault is of a type that requires the train to be stopped or if the operational fault is of a type that may be corrected remotely;

wirelessly communicate a fault message indicative of the operational fault to the lead locomotive; and receive a reset message that is wirelessly communicated to the unmanned locomotive from the lead locomotive in response to the fault message, the reset message directing the one or more components of the unmanned locomotive to reset, wherein the reset message is autonomously communicated to the unmanned locomotive without operator intervention after the lead locomotive receives the fault message indicative of the operational fault, wherein the reset message is communicated only if the operational fault is of the type that may be corrected remotely.

4. A system comprising:

a wireless communication system configured to link a first locomotive with an unmanned, second locomotive in a train that is in a distributed power (DP) configuration, the DP configuration including the first locomotive and the second locomotive coupled with each other by at least a railcar of the train and the second locomotive being controlled by the first locomotive; and a fault processor configured to be disposed on the second locomotive and to communicate a fault message to the first locomotive, wherein the fault message relates to a detected operational fault of the second locomotive, and said fault processor being further configured to initiate corrective action regarding the detected operational fault subsequent to receiving a fault reset message from the first locomotive, wherein the fault reset message is autonomously communicated to the second locomotive without operator intervention after the first locomotive receives the fault message, wherein the fault reset message is communicated to the fault processor only if the operational fault is of a type that may be corrected remotely.

5. A system comprising:

a distributed power communication system configured to wirelessly link a first locomotive in the train with an unmanned second locomotive in the train; and a fault processor configured to be disposed on the second locomotive, said fault processor also configured to wirelessly communicate a fault message to the first locomotive, wherein the fault message relates to a detected operational fault of the second locomotive, and said fault processor is further configured to initiate corrective action regarding the detected operational fault subsequent to wirelessly receiving a fault reset message from the first locomotive, wherein the fault reset message is autonomously communicated to the second locomotive without operator intervention after the first locomotive receives the fault message, wherein the fault reset message is communicated to the fault processor only if the operational fault is of a type that may be corrected remotely;

wherein the fault message and the fault reset message are configured according to a communication protocol for wireless transmission over the distributed power communication system in a first message format that is different than a second message format of distributed power messages transmitted over the distributed power communication system for distributed power control of the first and second locomotives.

* * * * *